US005234207A

United States Patent [19]

Lindstrom et al.

[11] Patent Number: 5,234,207

[45] Date of Patent: Aug. 10, 1993

[54] APPARATUS AND METHOD FOR ENHANCING SEPARATION OF WORKSHEETS

[75] Inventors: Mikko Lindstrom, Streamwood, Ill.; Antti Palomaki, Kauhava, Finland

[73] Assignee: Finn-Power International, Inc., Schaumburg, Ill.

[21] Appl. No.: 912,484

[22] Filed: Jul. 13, 1992

[51] Int. Cl.[5] ..... B65H 3/08

[52] U.S. Cl. ..... 271/11; 271/98; 271/106

[58] Field of Search ..... 414/795.5, 797; 271/5, 271/97, 98, 104, 105, 11, 106

[56] References Cited

U.S. PATENT DOCUMENTS 4,470,589 9/1984 Singer ..... 271/98 X 4,483,527 11/1984 Hashimoto ..... 271/98 X

FOREIGN PATENT DOCUMENTS 22745 1/1989 Japan ..... 271/105

*Primary Examiner*—Richard A. Schacher

*Attorney, Agent, or Firm*—Pollock, Vande Sande & Priddy

[57] ABSTRACT

To enhance the separation of sheet materials from a destacker, an air provider mechanism is attached to a frame of the carriage to bias against the being lifted sheet so as to maintain the air steam provided by an air ejector of the system directed to a location substantially immediately beneath the bottom surface of the being lifted sheet. Accordingly, as the sheet is being picked up, the air ejected from the air ejector system is directed to the gap between the being lifted sheet and its underlying sheets to enhance the separation of the being lifted sheet and the underlying sheets.

16 Claims, 5 Drawing Sheets

APPARATUS AND METHOD FOR ENHANCING SEPARATION OF WORKSHEETS

FIELD OF THE INVENTION

The present invention relates to loading mechanisms for a sheet working machine, or a machine center; and more particularly to an apparatus added to a loading mechanism for enhancing the separation of a worksheet from a stack of sheet materials.

BACKGROUND OF THE INVENTION

To fabricate a product from a sheet material, oftentimes a sheet machine center comes into play. Such machine center may be comprised of a turret punch, a right angle cutter, a laser cutter, or other machines for fabricating components out of a sheet of material, which may be metal, plastic, wood, etc.

Prior to the onset of automatic loader/unloader units that, together with the actual sheet working machine, form a machine center, each workpiece has to be manually loaded onto a work area of the sheet working machine. With an automatic loader, each sheet of material is usually picked up by a number of suction cups, attached to a carriage frame, and fed to the work area of the sheet working machine. Such automatic loader and unloader devices are well known, and are exemplified by, for example, the loader and unloader of the Finn-Power FMM2500, FMM3000, etc. machine centers.

In brief, to load a worksheet to the work area of the sheet working machine, the sheet is first picked up from a stack of sheets, from a so called de-stacker, by a number of suction cups attached to a carriage, which is movable vertically and horizontally. Thereafter, the carriage transfers the picked-up sheet from the de-stacker position to a position above the work area of the sheet working machine and deposits the sheet thereon. Thus, to transport a worksheet from the de-stacker, or the loading table where the sheets are placed, to the work area of the machine, the carriage first has to be lowered until its suction cups make contact with the worksheet on top of the stack. A suction force is next provided to the suction cups for securing the top sheet. Thereafter, the carriage is raised and moved horizontally from the loading table to the work area of the sheet working machine. The carriage is then lowered and the suction force removed from the suction cups to thereby deposit the worksheet onto the work area of the machine.

During the lifting of the top sheet from the stack of sheets, there commonly occurs a situation where the underlying sheet(s) would adhere to the top sheet, due to an under pressure of vacuum condition that may develop between adjacent stacked sheets. The adherence condition is further aggravated if, for example, a fluid such as lubricant or preservative is applied to the sheets prior to stacking. Thus, instead of lifting only the top sheet, the carriage, during the loading operation, may actually pick up some additional underlying sheet(s).

There are a number of ways prior art loading systems attempt to reduce the incidence of more than one sheet being lifted by a carriage during the loading process. Among those are the well known use of fanning magnets which tend to exert a magnetic force on the underlying sheets, if the worksheets are ferrous, so as to prevent them from being picked up at the same time as the top sheet. However, such fanning magnets do not work on nonferrous materials such as, for example, aluminum, plastic, etc.

Another attempt of separating the top sheet from the underlying sheets is disclosed in Jelinek et al. U.S. Pat. No. 4,703,925. There, a group of the suction cups (of the three groups disclosed in the embodiments) is caused to oscillate relative to the other groups so that shear forces are created between the suctioned top sheet and the underlying sheets to thereby cause the underlying sheets to be separated from the top sheet and fall back into the stack of sheets. It is further disclosed in '925 that a vertically oriented flattened fan-shaped blast of air may be directed to the side of the top sheet, to flow both above and below the top sheet, as the top sheet is being lifted by the suction cups. The '925 method works as long as the nozzle for providing the air blast is aligned correctly to the edge of the top sheet and there is a gap effected between the top sheet and its underlying sheets at the moment that the being lifted sheet(s) is/are passing by the air blast. Unfortunately, such is often not the case, as for example in the situation where a gap is not produced between the top sheet and its underlying sheet until after the lifted sheets are well beyond the blast of air from the nozzle. So, too, are there situations where the nozzle is aligned incorrectly so that its air blast is directed somewhere else. Moreover, due to the fact that the air nozzle of the '925 system is located some distance away from the edge of the top sheet, a substantial amount of the air output from the air nozzle is wasted.

BRIEF DESCRIPTION OF THE PRESENT INVENTION

To enhance the separation of worksheets, a conduit through which a fluid stream, for example air, passes is movably attached to a selected portion of the frame of the carriage. The conduit is configured such that at its end to which air is provided there is a nozzle assembly that includes a finger, or tongue, that extends beyond the nozzle. The conduit is so coupled to the frame that it is pivotable vertically to always bias the tongue against the top surface of the being picked up sheet. The nozzle is adjusted so that, as the tongue is biased against the top surface of the being picked up sheet, it is aimed substantially at a location immediately below the bottom surface of the being picked up sheet. Accordingly, as the top sheet is being lifted, an air stream provided by the nozzle is directed at the location immediately below the bottom surface of the top sheet, and more particularly into the gap area that is being formed by the oscillation of the top sheet. As a consequence, the gap between the top sheet and its underlying sheet(s) quickly propagates so that the separation of the sheets is enhanced. Advantageously, since the air stream provided by the conduit continues to be maintained at a location immediately below the bottom surface of the being picked up sheet, none is wasted. Moreover, since the nozzle assembly continues to be biased against the top surface of the being picked up sheet, the present invention system is impervious to any misalignment, even when there is bending movement of the top sheet.

An objective of the present invention is to therefore provide a simple, yet reliable, system for enhancing the separation of worksheets in a loading system.

DETAILED DESCRIPTION OF THE PRESENT INVENTION

Figure 1:
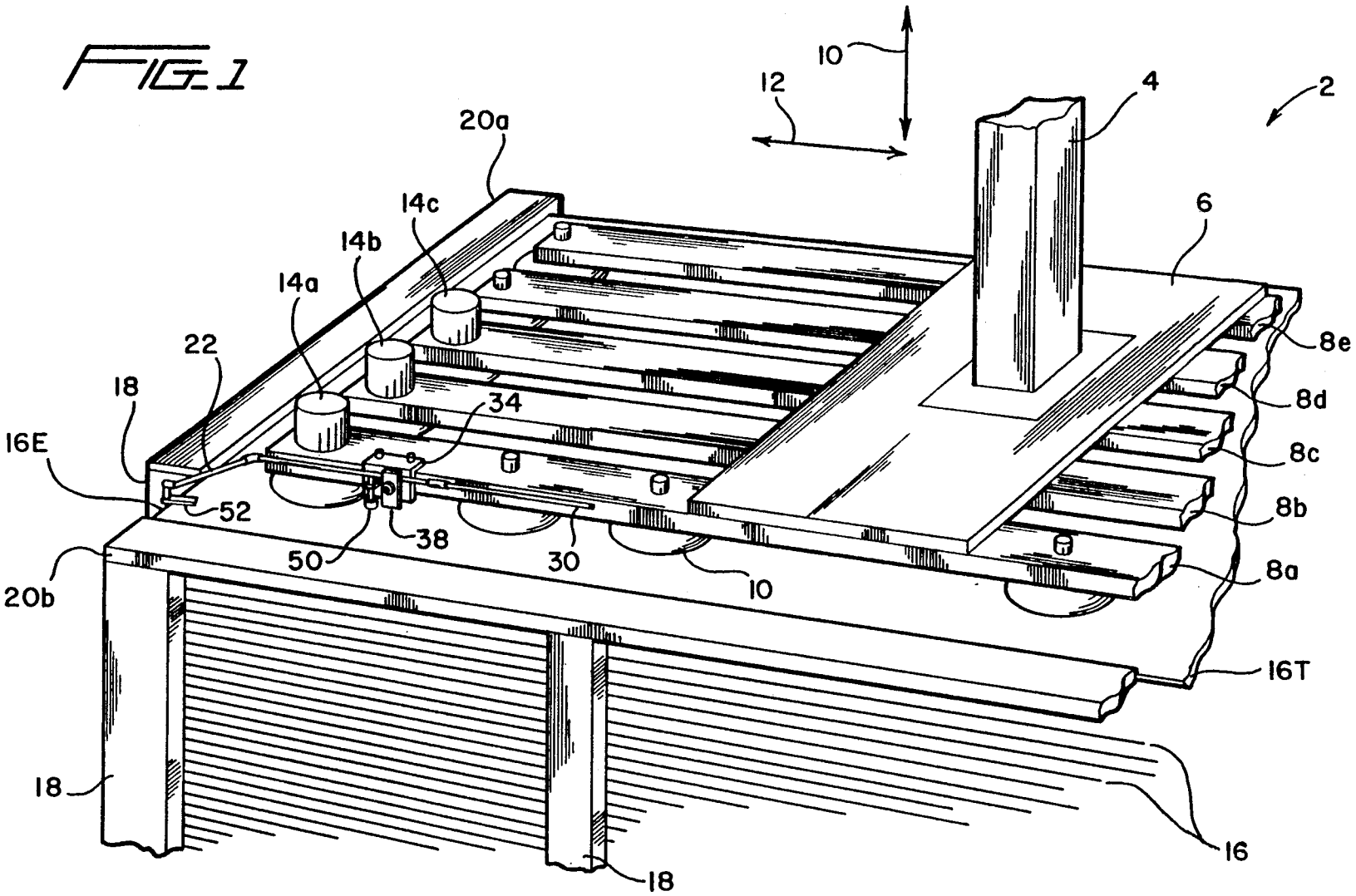
FIG. 1 is a semi-cutaway perspective view of a loader that has incorporated thereto the apparatus of the present invention.

With reference to FIG. 1, a portion of an unloader mechanism, otherwise referred to as a de-stacker, is shown to comprise a carriage 2 that includes a carriage post 4, a base 6, and a number of longitudinal members 8*a* to 8*e* attached to the base. Post 4 is attached to a lifting mechanism (not shown) that can move carriage 2 vertically, as indicated by bidirectional arrows 10. Carriage 2 is further connected, by means of post 4, to a moving mechanism (not shown) that can drive carriage 2 bidirectionally in a horizontal direction as indicated by bidirectional arrows 12. Thus, once carriage 2 has been lifted to an upward direction, it can be moved in a leftward direction (as shown in FIG. 1) so that it traverses from the position shown in FIG. 1 to a work position at the sheet working machine (not shown).

There are a number of pick-up means, such as suction cups 10, coupled to members 8*a*–8*e*. For the sake of clarity, only member 8*a* is shown to have suction cups 10 coupled thereto at regular intervals. Thus, albeit only one suction cup is shown in each of remaining members 8*b*–8*e*, it should be appreciated that those members also have pick-up members coupled thereto at regular intervals. Further for the sake of clarity, the hoses for providing suction force to the suction cups are not shown.

For carriage 2 of the embodiment of the present invention, exemplified for example by the unloader of the heretofore mentioned Finn-Power machine centers, there are mounted to the front end of members 8*a*, 8*b*, 8*c* corresponding movable suction cups driven either pneumatically, electrically or otherwise, by respective driver mechanisms 14*a*, 14*b* and 14*c*. For the remainder of the disclosure, those pick-up means together with their driver mechanisms will simply be referred to as oscillation cups 14*a*–14*c*. Oscillation cups 14*a*–14*c*, unlike the other suction cups coupled to carriage 2, are driven by their respective driver mechanisms in either a reciprocatory or oscillatory fashion relative to the remainder suction cups. Of course, it should be appreciated that the number of moveable suction cups (and their locations) may be different from that shown in FIG. 1, as different unloaders may be configured differently.

As shown in FIG. 1, carriage 2 is superposed over a stack of sheet materials (sheets) 16, which in turn rest on a loading table (not shown) which may have, for example, rollers (not shown). The stack of sheets placed on the loading table are pushed against front and side guide members 18, and particularly against top guide members 20*a* and 20*b*, for aligning sheets 16. Guide members 18 may be fanning magnets used to separate the worksheets, as for example top sheet 16*t* from its underlying sheets, when the top sheet is being lifted by the carriage. However, as was discussed earlier, a common problem with the separation of sheets, notwithstanding the fanning magnets, is that oftentimes the underlying sheets would adhere to the being picked up top sheet.

As was disclosed in the above-mentioned '925 patent, the use of an air jet, in addition to oscillating some of the suction cups relative to the others, do help in the separation of sheets. However, as was found by the inventors, the '925 method remains lacking in that its air jet oftentimes becomes misaligned and its air is blown both above and below the top sheet. The disclosure of the '925 patent is incorporated by reference herein for its explanation of the operation of the moveable suction cups, the general description of the movement of the carriage and the exemplar sensing means, i.e. the feeler gauges and sensing devices for sensing the engagement of the suction cups to the top sheet, which are conventional and not germane to the instant invention.

For the present invention, to enhance the separation of sheets, particularly top sheet 16*t* from its underlying sheets, there is coupled to carriage 2 a continuously aligned mechanism for ensuring that a fluid steam, air or otherwise, be continuously directed to a location immediately below the bottom surface of top sheet 16*t*.

Figure 2:
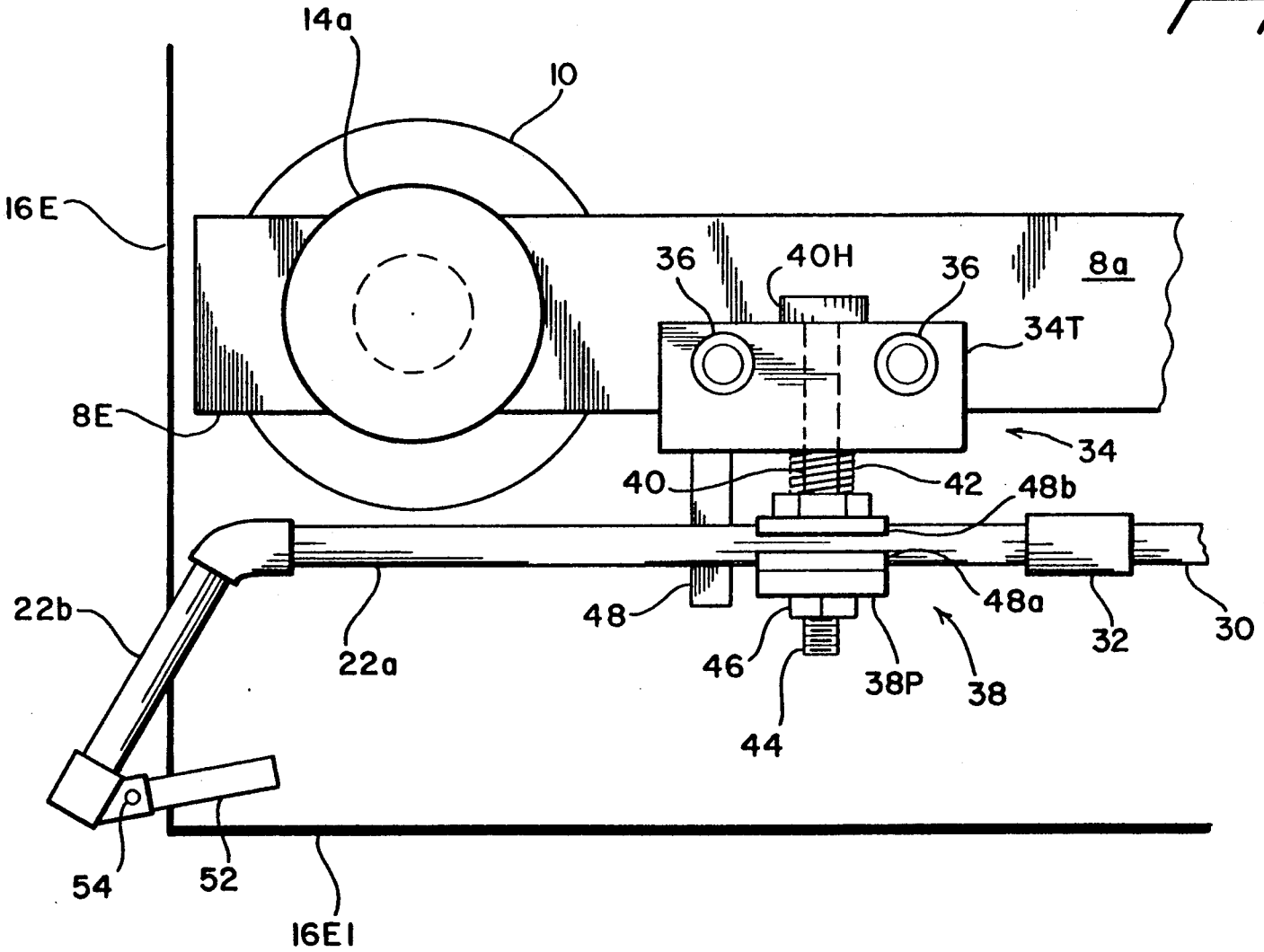
FIG. 2 is a plan view of a portion of the frame of the carriage to which the apparatus of the present invention has been incorporated.
Figure 3:
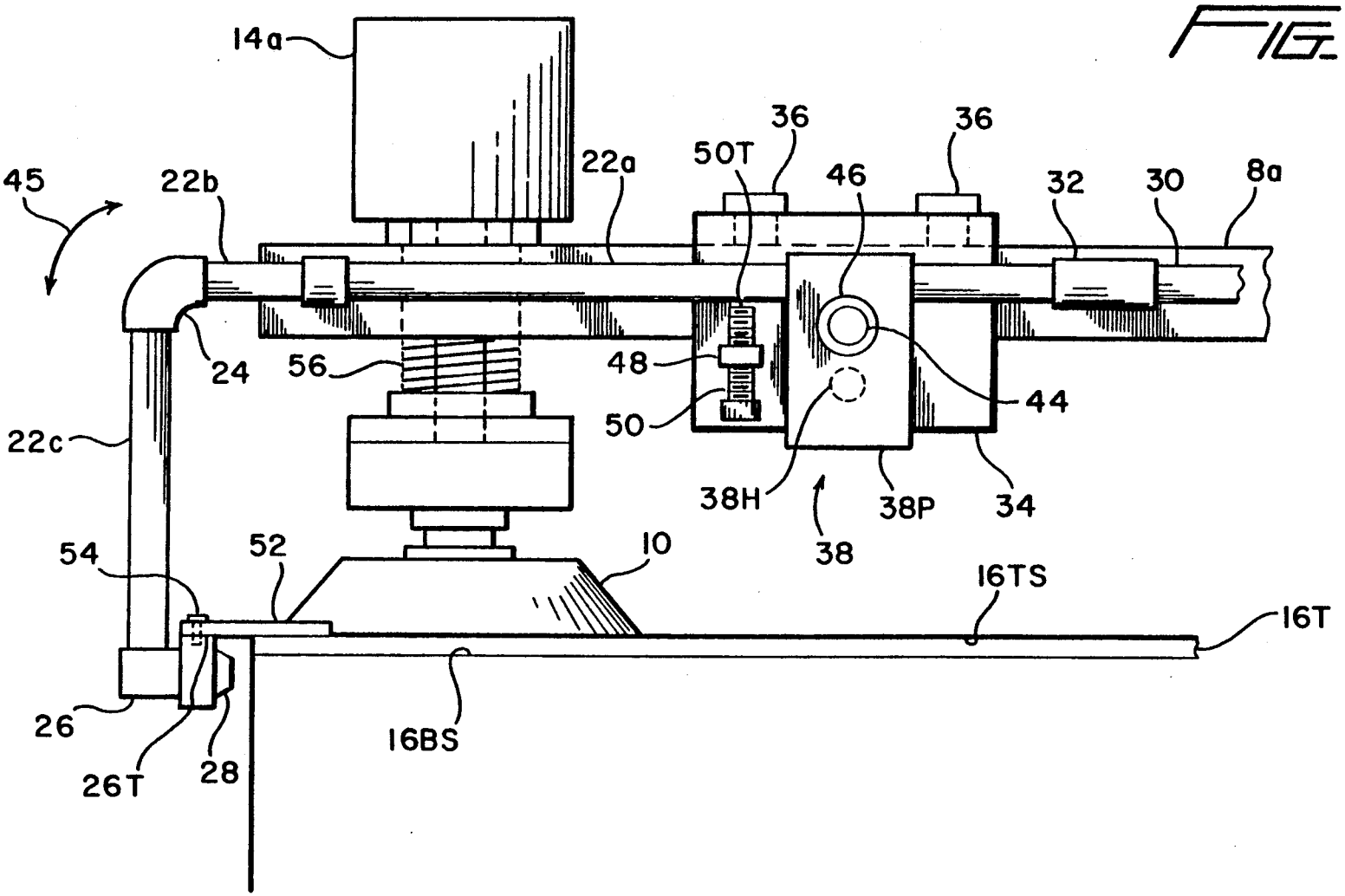
FIG. 3 is a side view of the apparatus of the present invention and the portion of the carriage frame of a loader to which it is coupled.

With reference to FIGS. 1, 2 and 3, the present invention apparatus is discussed hereinbelow. As shown, the present invention system has a conduit having a main portion 22*a* connected, via appropriate elbows, to a second section 22*b*, and a last section 22*c*. As more clearly shown in FIGS. 2 and 3, conduit section 22*a* runs substantially parallel to edge 8*e* of member 8*a*, while conduit section 22*b* extends away from edge 8*e* to position section 22*c* to hang, via elbow 24, in front of, and away from, front edge 16*e* of top sheet 16*t*. Mated to the end portion of conduit section 22*c* is a nozzle assembly 26, with its nozzle 28 positioned in proximate relationship to front edge 16*e* of top sheet 16*t*. Air is provided to conduit 22 via a hose 30 connected thereto via a coupling 32.

Conduit 22, more specifically section 22*a*, is movably coupled to member 8*a* via a bracket frame 34, which has an upside down L configuration, with the narrower portion 34*t* (FIG. 2) being bolted to member 8*a* by bolts 36. Movably mated to bracket 34, by means of a bolt 40, is a holder 38, which has a support plate 38*p* into which bolt 40 is threaded, per threaded hole 38*h* (see FIG. 3). A spring 42, fitted about the portion of bolt 40 which is not threaded into hole 38*h*, provides biasing for bolt 40 so that tension exists between plate 38 and bracket 34 to damp, but not restrict, the pivotable movement of conduit 22 along the directions indicated by pivotal arrows 45. The tension between bracket 34 and plate 38 may be adjusted by turning head 40*h* of bolt 40. Coupled to plate 38, by bolt 44 and nut 46, are circumferential fingers 48*a* and 48*b* for fixedly holding conduit section 22*a*. Accordingly, conduit 22, while being movably coupled in substantial parallel relationship to member 8a via bracket 34 and plate 38, is nonetheless pivotable about the point represented by hole 38H along the directions indicated by arrows 44.

Given the fact that conduit 22 is pivotable about point 38H, to ensure that conduit 22 does not exceed a predetermined downward pivot angle, integrated to bracket 34 is an extender finger 48 having a portion directly underneath conduit portion 22a being threaded with an adjustment screw 50. Thus, tip 50t of screw 50 prevents further downward movement of conduit portion 22a to maintain conduit 22 from pivoting downward beyond the predetermined angle.

To ensure that nozzle 28 continues to aim at a location at or immediately below bottom surface 16bs of top sheet 16t, a tongue 52 is integrated to nozzle assembly 26 above nozzle 28 so that the underside thereof would bias against the top surface 16ts of top sheet 16t. Thus, in effect, the apparatus of the present invention moves in synchronization with members 8a–8e, i.e. carriage 2.

To provide greater flexibility, instead of being integrated to nozzle assembly 26, tongue 52 may be fixedly coupled thereto by, for example a bolt 54, as shown in FIG. 3. Such arrangement allows the distance between the bottom surface of tongue 52 to be adjusted in relationship to nozzle 28, so that sheets of different thicknesses can be taken into consideration. For example, if a sheet material has a thickness greater than that of being illustrated top sheet 16t, height adjustment means which may include for example washers may be inserted between tongue 52 and nozzle assembly 26, at surface 26t, to increase the distance between the bottom surface of tongue 52 and nozzle 28 to ensure that nozzle 28 continues to aim at a location immediately below the bottom surface of the thicker sheet material. And since the air stream from nozzle 28 is directed below top sheet 16t, it matters not what the shape of the air stream is (fan-shaped, round or otherwise).

Figure 5:
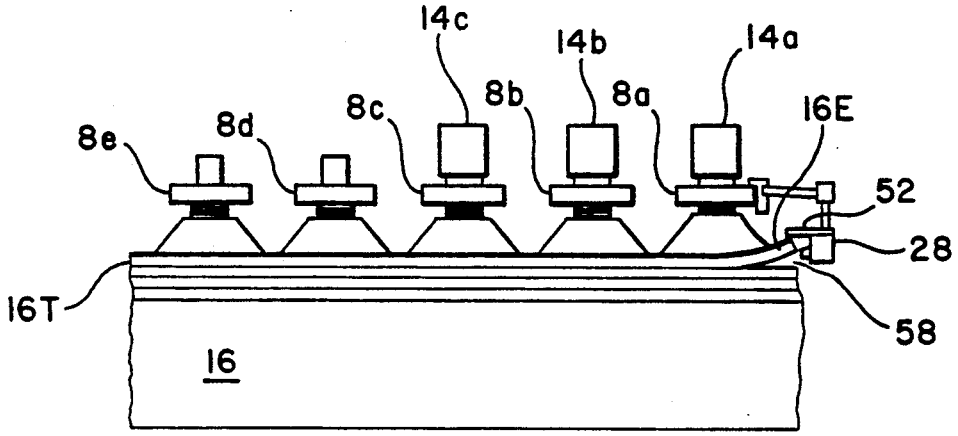
FIG. 5 is a second frontal view of the FIG. 1 perspective view in which the top sheet is shown to have been lifted somewhat and a gap is shown to begin to form between the top sheet and the underlying sheets.
Figure 6:
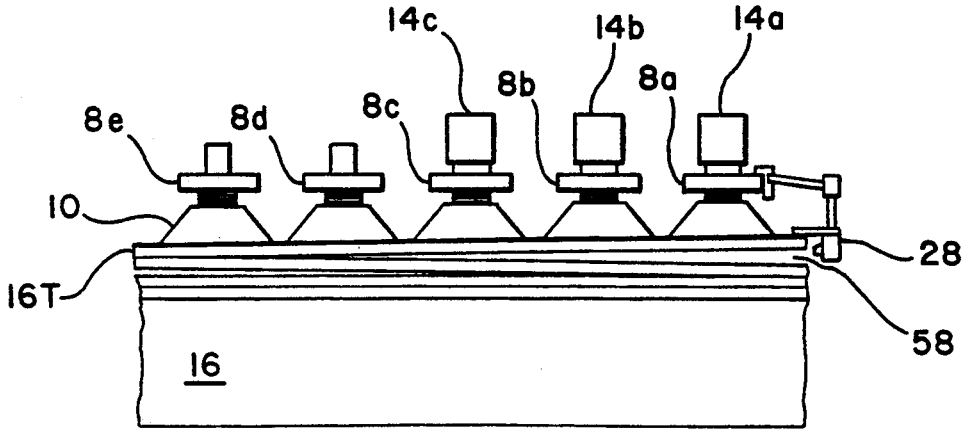
FIG. 6 is yet another frontal view of the FIG. 5 perspective view in which a wider gap is shown to have been perpetuated between the top sheet and its underlying sheets due to the air stream provided by the apparatus of the present invention.

The operation of the present invention is described with reference to FIGS. 4, 5 and 6, all of which, for the sake of simplicity, only show sufficient components to illustrate the operation of the present invention.

Figure 4:
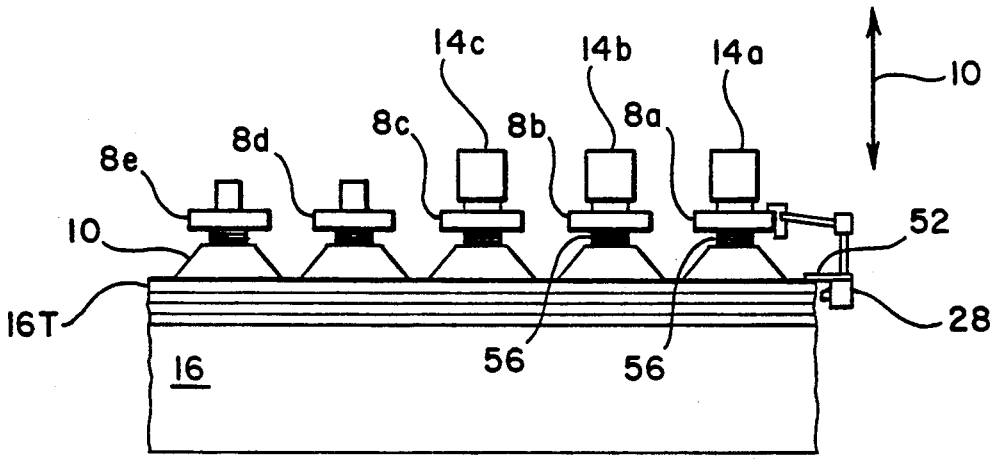
FIG. 4 is a frontal view of the FIG. 1 perspective view in which only the essential elements are shown to provide an understanding of the present invention.

In FIG. 4, members 8a–8e are shown to be at their lowered position such that their respective suction cups 10 rest on the top surface of top sheet 16t of the stack of sheet materials 16. At the appropriate time, top sheet 16t is secured by suction force being applied to the respective suction cups 10. As members 8a–8e move upward along the up direction of bidirectional arrows 10, all or at least one of oscillation cups 14a–14c are activated, either pneumatically or electrically, to effect a reciprocatory or oscillatory motion relative to other suction cups 10.

As the edge of top sheet 16t is bent by the movements of the oscillation cups 14a–14c, for example at 16e (FIG. 5), a gap 58 begins to form between the bottom surface of top sheet 16t and its underlying sheets. Since tongue 52 of the present invention is biased against the top surface of top sheet 16t, and remains thereat due to gravity and the tension provided to conduit 22 by spring 42 acting against bracket 34 and plate 38, the bottom surface of tongue 52 continues to be maintained in intimate contact with the top surface of top sheet 16t. Accordingly, nozzle 28, as its distance to tongue 52 is fixed, continues to move in synchronization with member 8a (and top sheet 16t) and direct its air stream to a location immediately below the bottom surface of top sheet 16t, irrespective of the position of top sheet 16t as it is being lifted, or any bending movement effected thereto by any one of oscillation cups 14a–14c. As a consequence, with specific reference to FIG. 6, the air stream, which may be under pressure, from nozzle 28 is blown between the bottom surface of top sheet 16t and the top surface of its underlying sheet, to thereby enhance the separation of those sheets. Although not limited to such time period, air is fed to conduit 22 at or just before the lifting of top sheet 16t and the end of the lifting process, i.e. before carriage 2 begins to move horizontally along directional arrow 12.

Figure 7:
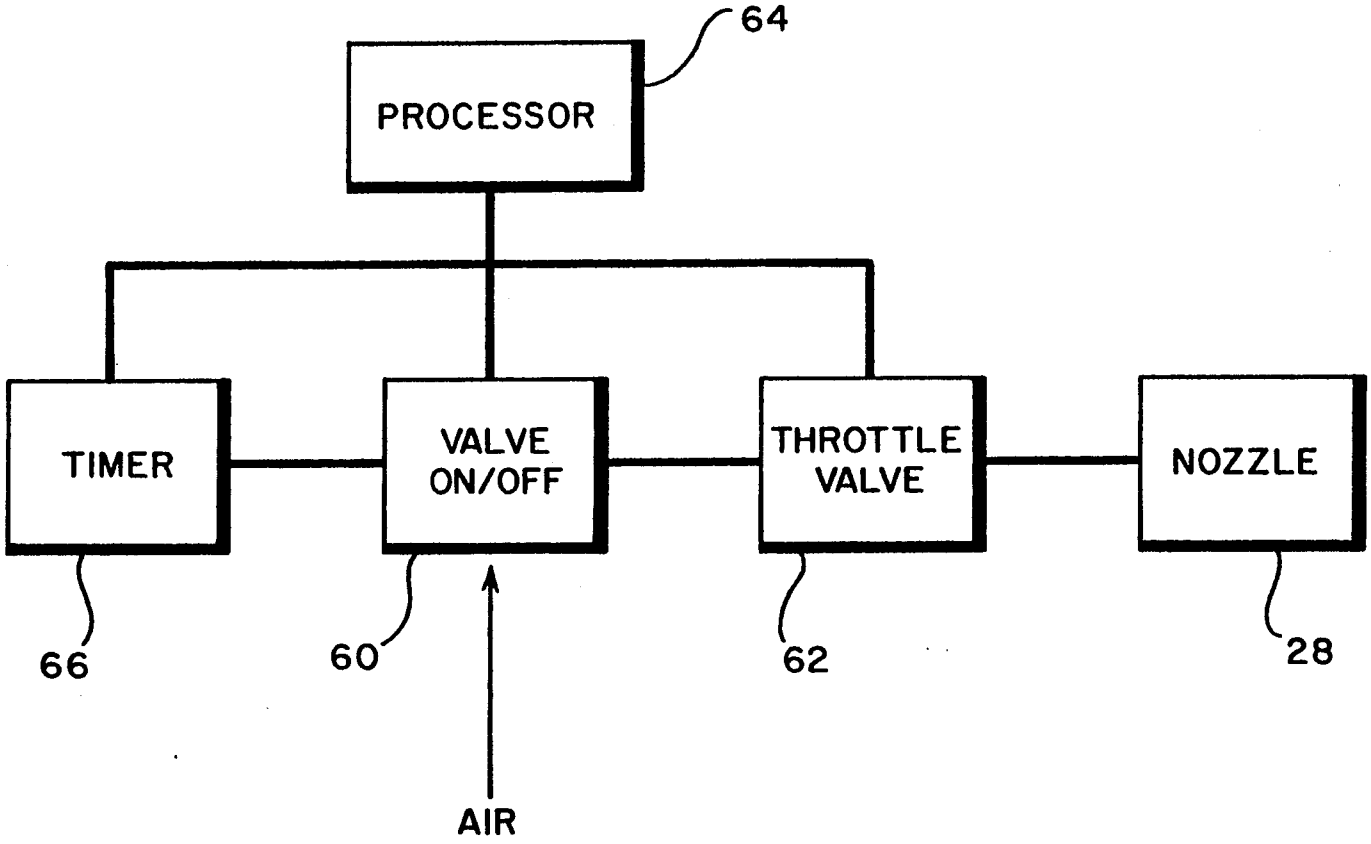
FIG. 7 is a block diagram illustrating the different components of the present invention.

To control the supply of air being ejected from nozzle 28, reference is directed to FIG. 7. There, it can be seen that air is provided to an on/off valve 60, which may be a conventional type of valve made, for example, by the Mecman Company of Sweden having part number 586-211000-1. The purpose of on/off valve 60 is, of course, to control the input of air to nozzle 28. As further shown, the output of valve 60 is provided to an input of a throttle valve 62 which, for the embodiment of the present invention, may be a Mecman type 344/125 Model A valve. The purpose of throttle valve 62 is to control the air flow, or the amount of air, provided to nozzle 28. Such throttle control is necessary to ensure that lighter sheet materials would not be blown away by the air stream supplied by nozzle 28.

The amount of time during which air is provided to nozzle 28, via hose 30 and conduit 22, is predetermined and controlled by, for example a conventional processor 64, which may be a part of the control unit that controls the overall operation of the loader and the machine center. Commands provided by processor 64 are sent to a timer 66 which, for the embodiment of the present invention, is a Potter & Brumfield 24VDC adjustable recycle timer having Model Number CRD-48-30180. The purpose of timer 66 is to control the on/off cycles of valve 60 so that air is directed to the location immediately below the lower surface of the top sheet during only a given time period. Of course, the amount of air provided to nozzle 28 is, as was noted previously, controlled by throttle valve 62. Furthermore, do note that, instead of timer 66, different types of relays, or solenoids, may be used to control the operation of on/-off valve 60.

With respect to nozzle 28, it should be appreciated that instead of having only one output that is directed to a single edge, for example edge 16e of sheet 16t, a V-shaped nozzle having two outputs each directed to a corresponding edge, for example 16e and 16el (see FIG. 2), may be used. Accordingly, nozzle 28 could eject two air steams, from edge 16e and 16el, into the gap effected by the reciprocatory motions of oscillation cups 14. Such V-shaped nozzle, due to its additional ejected amount of air, further enhances the separation of the secured sheet from its underlying sheets.

Inasmuch as the present invention is subject to many variations, modifications, and changes in detail, it is intended that all matter described throughout this specification and shown in the accompanying drawings be interpreted as illustrative only and not in a limiting sense. Accordingly, it is intended that the invention be limited only by the spirit and scope of appended claims.

I claim:

1. In a sheet de-stacker in which each top sheet is separated, one at a time, from a stack of sheets for transport to a sheet working machine, said de-stacker including a carriage movable vertically at and bidirectionally between a position superposing over said stack of sheets and a position for depositing a picked-up sheet onto a working area of said sheet working machine, at least one pick-up means attached to said carriage for securing a top sheet from said stack of sheets when said carriage is lowered to said stack of sheets, an improvement for enhancing the separation of said top sheet from the other sheets of said stack of sheets, comprising:

means for outputting at least one fluid stream movable in synchronization with said carriage at least during the time when said top sheet is being separated from said other sheets;

means using said top sheet as a reference for maintaining said fluid stream output means at a position relatively fixed to at least one edge of said top sheet such that said fluid stream output from said fluid stream output means remains directed to said edge at a location substantially immediately beneath the bottom surface of said top sheet irrespective of the position or movement of said top sheet at least during the time when said top sheet is being separated from said other sheets to thereby enhance the separation of said top sheet from the sheet immediately underneath said top sheet.

2. The improvement of claim 1, wherein said fluid stream output means comprises:

a conduit movably attached to said carriage for providing passage for said fluid stream input to one end of said conduit;

a nozzle fixed to the other end of said conduit for outputting said fluid stream.

3. The improvement of claim 2, wherein said maintaining means comprises:

guide means for keeping said nozzle in fixed relationship to said top sheet to aim said nozzle at said location immediately beneath the bottom surface of said top sheet.

4. The improvement of claim 1, wherein said fluid stream comprises air.

5. The improvement of claim 3, wherein said guide means comprises:

a tongue coupled to and extending beyond the tip of said nozzle, said tongue biasing against the top surface of said top sheet at said edge thereof to position said nozzle to aim at said location immediately below the bottom surface of said top sheet.

6. The improvement of claim 2, further comprising:

valve means activable to provide said fluid stream, for a predetermined period of time, to said conduit for outputting to said location immediately beneath said top sheet.

7. The improvement of claim 1, wherein said fluid stream outputting means comprises a nozzle means having two outputs for providing two fluid streams each respectively directed substantially to the underside of a corresponding edge of two adjacent edges of said top sheet.

8. In a sheet de-stacker in which each top sheet is separated, one at a time, from a stack of sheets for transport to a sheet working machine, said de-stacker including a carriage movable vertically at and bidirectionally between a position superposing over said stack of sheets and a position for depositing a pick-up sheet onto a working area of said sheet working machine, at least one pick-up means attached to said carriage for securing a top sheet from said stack of sheets when said carriage is lowered to said stack of sheets, a method of enhancing the separation of said top sheet from the other sheets of said stack of sheets, comprising the steps of:

(a) outputting at least one fluid stream movable in synchronization with said carriage at least during the time when said top sheet is being separated from said other sheets;

(b) using said top sheet to reference the directing of said fluid stream to at least one edge of said top sheet at a location substantially immediately beneath the bottom surface of said top sheet irrespective of the position or movement of said top sheet at least during the time when said top sheet is being separated from said other sheets to thereby enhance the separation of said top sheet from the sheet immediately underneath said top sheet.

9. The method of claim 7, wherein said fluid stream comprises an air stream; and wherein step (b) further comprises the step of:

guiding said air stream to an edge of said top sheet at said portion undergoing separation.

10. The method of claim 9, wherein step (b) further comprises the step of;

using the top surface of said top sheet as a reference to effect said guiding step.

11. The method of claim 8, wherein step (a) further comprises the step of:

outputting two fluid streams each respectively directed substantially to the underside of a corresponding edge of two adjacent edges of said top sheet.

12. Apparatus for separating top sheets, one at a time, from a stack of sheets for transport, said apparatus including a carriage movable vertically at and bidirectionally between a position superposed over said stack of sheets and a position for depositing a picked-up sheet, at least one pick-up means attached to said carriage for securing a top sheet from said stack of sheets when said carriage is lowered to said stack of sheets, said apparatus comprising:

conduit means movable in synchronization with said carriage to convey at least one fluid stream at least during the time when said top sheet is being separated from said other sheets;

means referencing said top sheet for establishing a fixed relationship between an output of said conduit means and at least one edge of said top sheet such that said fluid stream conveyed by said conduit means remains substantially directed to immediately below an edge of said portion of said top sheet undergoing separation irrespective of changes in the positioning or movement of said top sheet at least during the time when said top sheet is being separated from said other sheets.

13. Apparatus of claim 12, wherein said conduit means is movably coupled to said carriage, said output of said conduit means having fitted thereto a nozzle for shaping said fluid stream.

14. Apparatus of claim 13, wherein said establishing means comprises;

a tongue coupled to and extending beyond the tip of said nozzle for biasing against the top surface of said top sheet at said edge thereof to aim said nozzle to immediately below said edge of said portion of said top sheet.

15. Apparatus of claim 12, further comprising:

means to provide said fluid stream to said conduit means for the period of time before said top sheet is moved from said position superposed over said stack of sheets to said position for depositing.

16. Apparatus of claim 12, wherein said conduit means comprises two outputs for providing two fluid streams each respectively directed substantially to the underside of a corresponding edge of two adjacent edges of said top sheet.

* * * * *